United States Patent [19]

Kimura

[11] Patent Number: 4,938,050

[45] Date of Patent: Jul. 3, 1990

[54] SMALL-DIAMETER METALLIC CONDUIT BENDING MACHINE

[75] Inventor: Sadao Kimura, Numazu, Japan

[73] Assignee: Usui Kokusai Sangyo Kaisha Ltd., Nagasawa, Japan

[21] Appl. No.: 369,850

[22] Filed: Jun. 22, 1989

[51] Int. Cl.[5] ..... B21D 7/024

[52] U.S. Cl. ..... 72/306; 72/381; 72/388; 72/217

[58] Field of Search ..... 72/306, 319–321, 72/381, 384, 387, 388, 216–219, 403, 446

[56] References Cited

U.S. PATENT DOCUMENTS

| | | | |
|---|---|---|---|
| 2,305,850 | 12/1942 | Drysdale | 72/321 |
| 2,366,012 | 12/1944 | Draper et al. | 72/217 |
| 4,090,387 | 5/1978 | Dubreuil | 72/217 |
| 4,662,204 | 5/1987 | Saegusa | 72/306 |
| 4,735,075 | 4/1988 | Saegusa | 72/306 |
| 4,747,768 | 5/1988 | Crupi | 72/381 |
| 4,805,436 | 2/1989 | Saegusa | 72/306 |

*Primary Examiner*—Daniel C. Crane

*Attorney, Agent, or Firm*—Anthony J. Casella; Gerald E. Hespos

[57] ABSTRACT

A small-diameter metallic conduit bending machine comprises a stationary frame segment and a movable or separated frame segment, each including a bending station. Where a metallic conduit seems to interfere with the movable frame segment kept in its normal position when the metallic conduit is bent by a bending member, the movable frame segment is displaced to avoid interference, a subsequent bending work is performed beforehand, and then the subject bending work is performed after the movable frame segment is returned to its normal position.

15 Claims, 3 Drawing Sheets

SMALL-DIAMETER METALLIC CONDUIT BENDING MACHINE

BACKGROUND OF THE INVENTION

1. Field of the Invention

This invention relates to a machine for bending a small-diameter metallic conduit at several points and more particularly, to a small-diameter metallic conduit bending machine adapted to shape a metallic conduit whose individual bend sections differ in the bend direction three-dimensionally from one another, not lying on the same plane, such as the fuel pipeline or brake pipeline of a car.

2. Description of the Prior Art

A convenient small-diameter metallic conduit bending machine of the foregoing type, as disclosed in U.S. patent application Ser. No. 340,224 filed on Apr. 19, 1989 comprises a stationary frame formed by connecting bar stock or pipe stock together into a shape substantially conforming to the finished curved shape of a metallic conduit over the whole length and having in a bend section a guide surface or the like defined by a surface which has a curvature smaller than the bend radius of the metallic conduit in its lengthwise direction and is substantially orthogonal to a bend plane in its widthwise direction, and a bending member having a peripheral surface facing the guide surface and being moved toward the stationary frame by actuator attached to the frame. With this machine, the bending work is carried out by securing one end or a given intermediate portion of the straight metallic conduit by means of a clamp tool or the like (see FIG. 2) and pressing the bending member against the frame by moving the bending member straightly or circularly toward the frame progressively from the second end or intermediate portion toward the other free end or both free ends.

In the foregoing conventional small-diameter metallic conduit bending machine, however, the bending work sometimes cannot be completed because an end portion or the like of the metallic conduit tends to interfere with other parts of the machine, a floor or the like while the metallic conduit is being bent by the bending member.

SUMMARY OF THE INVENTION

Therefore, it is an object of the present invention to provide a bending machine capable of performing the bending work successively without causing interference of an end portion or the like of a metallic conduit with other parts of the machine, a floor or the like while a bending member is bending the metallic conduit.

To achieve the foregoing object, a bending machine of the present invention comprises a stationary frame formed by connecting bar stock or pipe stock together into a shape substantially conforming to the finished curved shaped of a metallic conduit over the whole length. A first bending station provided on the stationary frame and includes a first guide surface defined by a surface which has a curvature smaller than the bend radius of the metallic conduit in its lengthwise direction and is substantially orthogonal to a bend plane in its widthwise direction. A second bending station is provided on the stationary frame and includes a second guide surface defined by a surface substantially parallel to the bend plane and a guide member which is secured to the stationary frame susbtantially orthogonally to the second guide surface and has a curvature smaller than the bend radius of the metallic conduit. A bending member is moved toward the stationary frame by an actuator attached to the frame such that the metallic conduit is bent so as to lie along the first guide surface in the first bending station or along the second guide surface and the guide member in the second bending station.

With this configuration, for the purpose of preventing the metallic conduit from interfering with other parts of the machine, a floor or the like when the metallic conduit is bent by the bending member, a portion of thr frame is previously separated from the remainder including a subject bending station. The separated frame portion, including a subsequent bending station, is pivotably connected to the remainder at a position in the vicinity of a subject bending station. The separated frame portion is displaced by an actuator from its normal position such that the end-of-bending position, of the preceding bending work of the remainder and the start-of-bending positions of the subject and subsequent bending stations lie substantially on the same straight line. The subsequent bending work is performed beforehand in the subsequent bending station on the straight line, and then, the subject bending work is performed in the subject bending station with the metallic conduit held down in both end portions after returning the separated frame portion on the side of the subsequent bending station to its normal position by means of the actuator.

The operation of the present invention is identical with that of the prior patent applicaton in that the bending work is carried out by means of the stationary frame which includes the guide surface, and the bending member which is moved toward the guide by the actuator, such as air cylinder or rotary actuator, attached to the frame such that the metallic conduit is bent so as to liw along the guide surface or along the guide surface and the guide member. However, according to the present invention, where an end portion or the like of the metallic conduit seems to interfere with other parts of the machine, a floor or the like in the bending work, the subject bending work is performed after one subsequent bending work is performed beforehand; hence, the metallic conduit cannot interfere with other parts of the machine, a floor or the like, and a series of bending works can be carried out without hindrance.

BRIEF DESCRIPTION OF THE DRAWINGS

FIG. 1(*b*) is a fragmentary perspective view of the embodiment after the bending work is performed.

DETAILED DESCRIPTION OF THE PREFERRED EMBODIMENTS

Figure 1A:
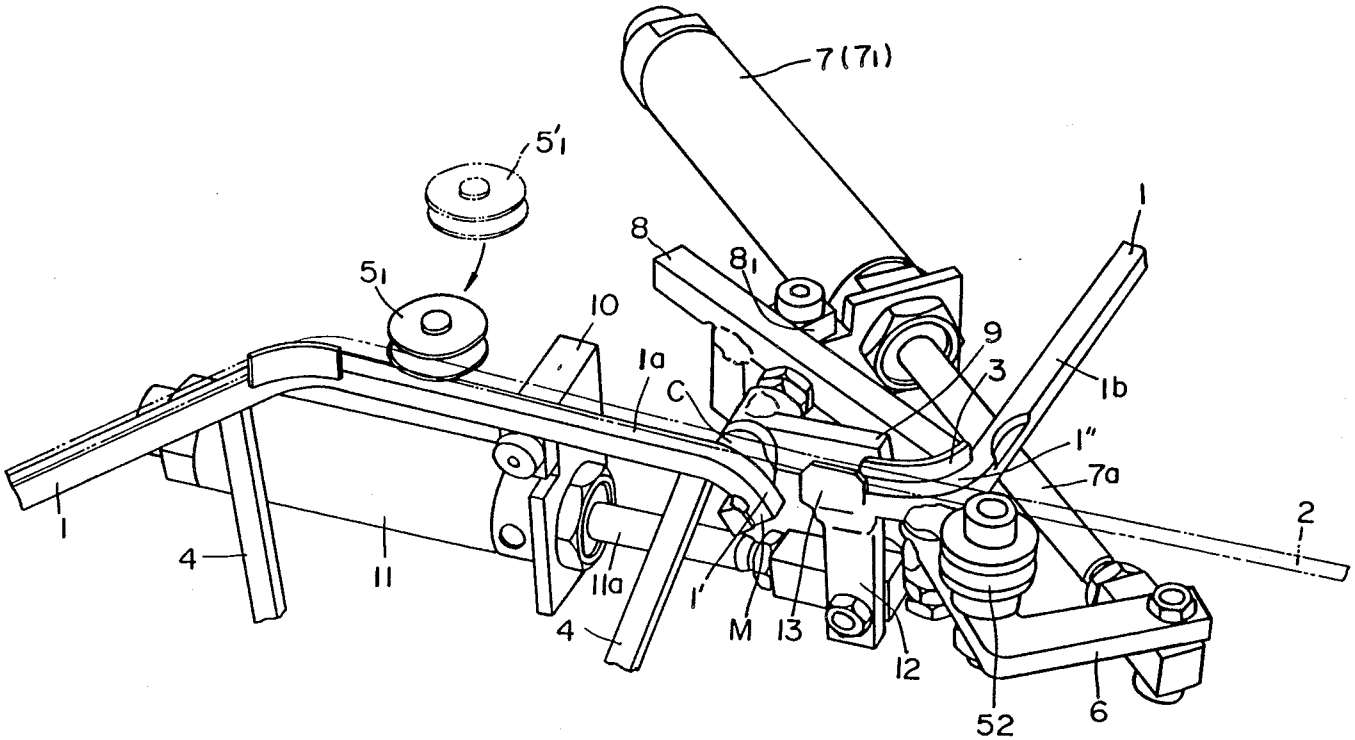
FIG. 1(*a*) is a fragmentary perspective view showing an embodiment of a bending machine according to the present invention.
Figure 1B:
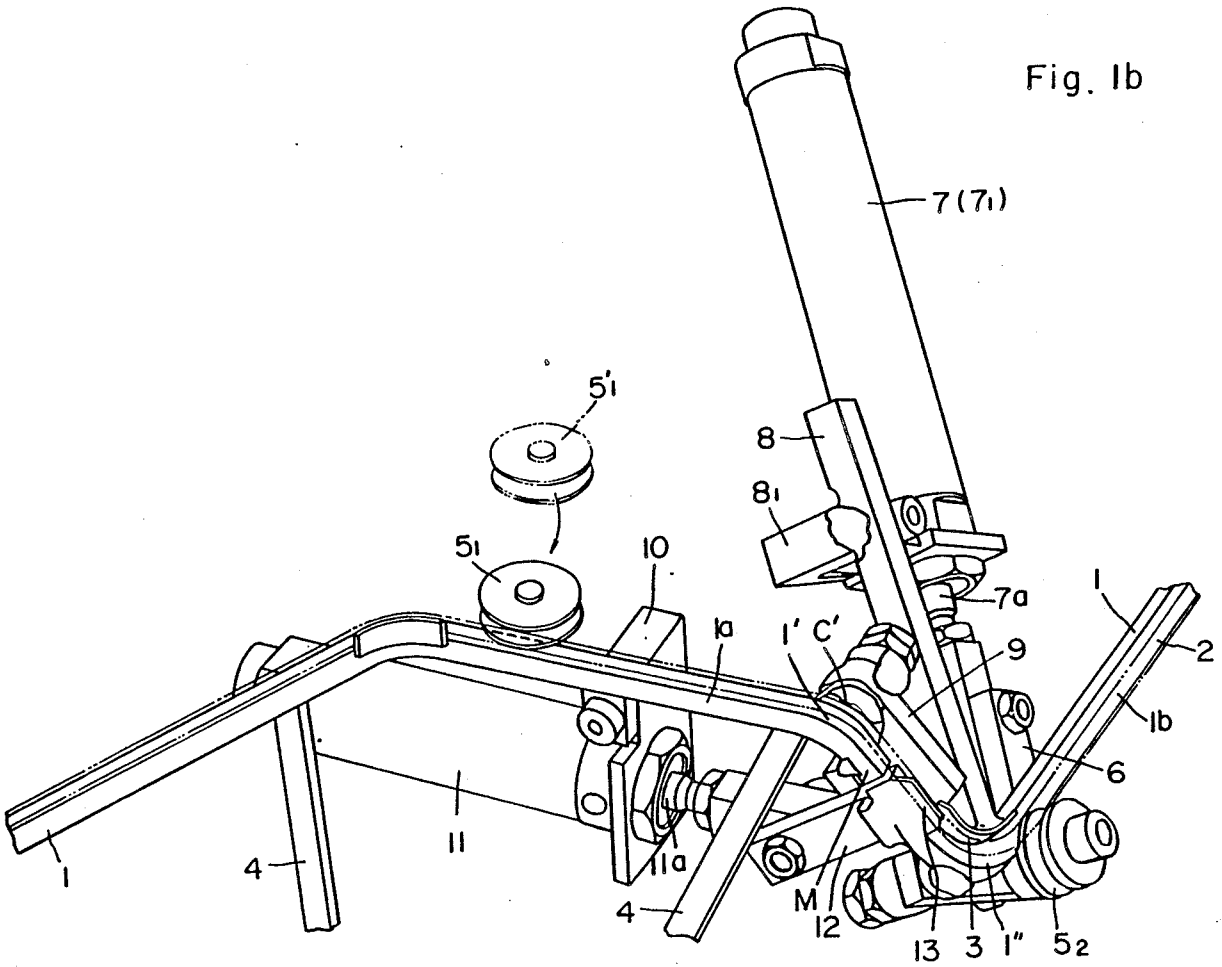
Figure 2:
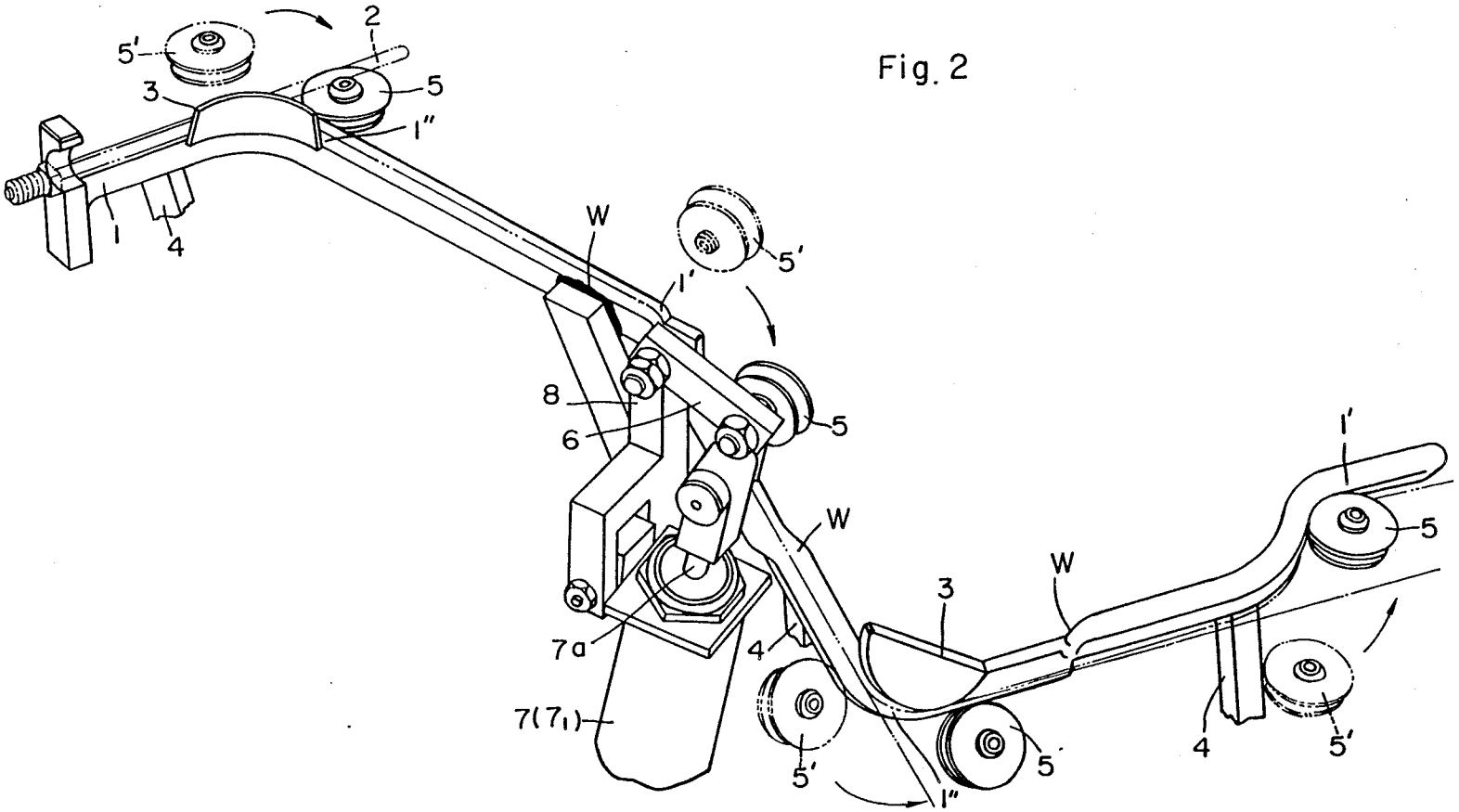
FIG. 2 is a schematic perspective view of a stationary frame.

Reference numeral 1 designates a generally elongate three-dimensionally-shaped stationary frame which is formed by connecting bar stock, pipe stock or the like together through welding W into a continuous shape substantially conforming to the finished curved shape of a metallic conduit 2 over the whole length and has, in the vicinity of a bend section, preferably within the range of bend angle, a first guide surface 1′ substantially orthogonal to a first bend plane and a second guide surface 1″ defined by a surface substantially parallel to a second bend plane. This stationary frame has a flat portion in sectional contour, or preferably is substantially quadrangular in cross section. However, the sectional shape of the second guide surface 1" is not necessarily limited to the above, but may be circular. In this latter case, the second guide surface 1" means a surface defined by lines tangential to the outer peripheral surface of the metallic conduit 2 which extend substantially orthognally to a guide member 3 hereinafter described. At a given position of the frame 1 where the metallic conduit 2 is bent, a guide member 3 is secured by welding or the like substantially orthogonally to the first guide surface 1' and the second guide surface 1". The curvature or shape of each of the first guide surface 1', second guide surface 1", guide member 3, frame 1 and the like is made smaller than the bend radius of the metallic conduit 2 in consideration of the spring back of the metallic conduit 2 that arises at the time of bending. Here, the guide member 3 may be made of a plate piece or block. Although the frame 1 is secured on a base (not shown) by means of a necessary number of posts 4, such a base is not necessarily needed if the posts 4 are connected together. 5, $5_1$ and $5_2$ are bending members which are disposed so as to move toward the stationary frame 1 while pressing the metalic conduit 2 against so as to lie along the first surface 1' or along the second guide surface 1" and the guide member 3. Specifically, the bending member for performing the bending work in cooperation with the first guide surface 1' is disposed so that its peripheral surface faces the first guide surface 1', whereas the bending member for performing the bending work in cooperation with the second guide surface 1" and the guide member 3 is disposed so that its moving direction is substantially parallel to or slightly inclined from the second guide surface 1". In FIGS. 1 and 2, the two-dot chain line $5_1'$, 5' designates the position of the bending member before the bending work. Further, the bending member $5_2$ is attached to a lever 6, and this lever 6 extending outward is pivoted at its center of rotation of the frame 1 at a position in the vicinity of the bend section of the metallic conduit 2. The outer end of the lever is rotatably supported by the distal end of a piston rod 7*a* forming an actuator 7 (the drawing shows an air cylinder $7_1$), and one end of the air cylinder $7_1$ is pivoted to brackets 8 and $8_1$ attached to the frame 1, so that the lever can turn in the direction of the piston rod respondingly to the extension/retraction of the piston rod 7*a*. The bending member 5, $5_1$, $5_2$ may be actuated by a rotary actuator as disclosed in the prior patent application, as well as the air cylinder $7_1$ illustrated herein serving as the actuator 7.

The bending work of the metallic conduit 2 will now be described. At first, similarly to the prior art, one end of the metallic conduit 2 is locked and secured to a lock member mounted at one end of the frame 1 by the use of an end fixture (see FIG. 2) in a first mode, or a given point in an intermediate portion of the metallic conduit 2 which is indexed using a stopper or the like is secured to an intermediate portion of the frame 1 by the use of a clamp tool or the like in a second mode. Then, the bending work is carried out from the secured end toward the free end in the first mode, or from the secured portion toward both free ends in the second mode, by causing the circular movement of the bending member 5 progressively toward the frame 1 such that the metallic conduit 2 is pressed against so as to lie along the first guide surface 1' or along the second guide surface 1" and the guide member 3 of the frame 1 in contact therewith.

In the foregoing work, an end portion of the metallic conduit 2 sometimes interferes with other parts of the machine, such as the frame or bending member, a floor or the like while the bending member 5 is successively bending the metallic conduit 2. To prevent such interference, according to the present invention, the stationary frame 1 is separated into two in the vicinity of the bend section, preferably in the vicinity of a termination-of-bending portion, where an end portion or the like of the metallic conduit will cause interference during bending, and one of the thus separated frame portions or segments with which interference will occur is made turnable. Specifically, as shown in FIG. 1(*b*), the stationary frame 1 is separated into frame segments 1*a* and 1*b* with leaving a bending station M (a downwardly curved portion in the drawing) of the stationary frame 1. An arm 9 is provided whose one end is pivoted at a point C in the vicinity of the bending station M, and is connected with the other separated frame segment 1*b*. The frame segment 1*b* as a whole can turn about the point C and can twist upward by virtue of an air cylinder 11 attached to the frame segment 1*a* such that the straight metallic conduit 2 before bending lies on both frame segments 1*a* and 1*b*. Specifically, a lever 12 is pivoted to the distal end of a piston rod 11*a* of the cylinder 11 which in turn is pivoted to a bracket 10, and the other end of this lever 12 is welded to the distal end of the frame segment 1*b*. When the cylinder 11 is actuated from the state of FIG. 1(*b*) to extend the piston rod 11*a*, the distal end of the frame segment 1*b* is twisted upward through the interlocking of the lever 12, and the distal end of the frame segment 1*b* comes onto a prolonged line of the frame segment 1*a* (see FIG. 1(*a*)).

Therefore, the end-of-bending position of the preceding working step, and the start-of-bending position of the subject bending station M, of the frame segment 1*a*, and the start-of-bending position of the subsequent bending station of the frame segment 1*b* lie substantially on the same straight line.

In this state, the metallic conduit 2 is bent beforehand with the bending member $5_2$ via the L-shaped lever 6 by actuating the air cylinder $7_1$in the bend section on the frame segment 1*b* which is the subsequent bending station (corresponding to the position of the guide member 3). At this moment, the metallic conduit 2 is held down onto the frame segment 1*a* by the bending member $5_2$ upon the termination of bending and by the bending member $5_1$ of the bending station preceding to the bending station M. Then, the air cylinder 11 is actuated (to retract the piston rod 11*a*); as a result, the metallic conduit 2 is bent so as to lie along the given frame (or so as to have a shape conforming to the guide surface 1' of the bending station M of FIG. 1(*b*)) because it is secured on both sides of the bend section even though no bending member is provided in the bending station M. Where it is judged from the preceding bending work that the frame segment 1*b* causes no interference, the displaced state of FIG. 1(*a*) may be maintained for the bending work of a next metallic conduit after the metallic conduit 2 having been bent is removed from the frame. A holding plate 13 is provided for preventing the metallic conduit, which receives the reaction of bending upon being bent by the frame segment 1*b*, from coming off, thereby keeping a desired degree of bending accuracy. The present invention can be applied in bending bar stock, as well as metallic conduits.

As described above, even where other parts of the machine, a floor or the like seems to cause interference with a passage along which the metallic conduit 2 moves when being bent, according to the present invention, the subjec bending work is carried out after at least one subsequent bending work has been completed beforehand; thus, the bending work of the metallic conduit 2 can be performed successively without hindrance.

Although the embodiment as shown the case where the bend planes of two successive bending stations intersect each other, the present invention can be applied also to where they occupy the same plane.

As described in greater detail, according to the present invention, the bending work is carried out by means of the stationary frame and the bending member which is moved toward the guide by the actuator attached directly or via the posts or brackets to the frame such that the metallic conduit is bent so as to lie along the guide and the guide surface or second guide surface. Therefore, since the actuator for actuating the bending member is connected to the stationary frame, flexure is prevented from appearing because no stay nor the like is used. Since the bending work is performed in response to the bending member, preferably as the piston rod is pulled by the actuator, the influence of looseness of a bush provided for the piston rod can be reduced minimum, in contrast to the prior art wherein the pushed or extended state is utilized for actuation, and no appreciable bending moment can be imposed. Accordingly, the generation of even a minute discrepancy (breathing) between the bending member and the guide can be prevented, whereby curved products of high accuracy can be fabricated.

Further, where an end portion or the like of the metallic conduit seems to interfere with other parts of the machine, a floor or the like when the metallic conduit is bent by the bending member, one of the frame segments previously separated is displaced to perform one subsequent bending work beforehand, and then, the preceding or subject bending work is performed after the one frame segment displaced is restored; thus, a series of bending works can be carried out successively without hindrance. Further, since the whole bending machine can be composed by cutting square bar stock or the like on sale to given lengthes, bending each bar element, welding these bar elements, except a part, into a continuous shape substantially conforming to the finished curved shape of the metallic conduit over the whole length, securing the plate-like guides at given positions to form the frame, disposing the bending members (inclusive of the actuators) as able to operate toward the frame, and making a part or segment of the frame turnable, the parts can be remarkably decreased, the machine can be made small in size, light in weight, and low in manufacturing cost, and can be manufactured in a very short time; hence, it is possible to surely put the machine in a serviceable state before the starting of mass production.

What is claimed is:

1. A small-diameter metallic conduit bending machine for bending a metallic conduit into a finished curved shape, said machine comprising:

a frame having a shape subsantially conforming to the finished curved shape of the metallic conduit over the whole length, a first bending station being provided on the frame and including a first guide surface having a curvature in its lengthwise direction and extending substantially orthogonal to a first bend plane in its widthwise direction, a second bending station being provided on the frame and including a second guide surface extending substantially parallel to a second bend plane and a curved guide member which is secured to the frame substantially orthogonally to the second guide surface, and a bending member which is selectively movable toward and away from the frame by an bending member actuator attached to the frame such that the metallic conduit is bent soo as to lie along at least one surface selected from the first guide surface in the first bending station and the second guide surface and the guide member in the second bending station, said machine being further characterized in that for the purpose of preventing the metallic conduit from interfering with other parts of the machine, a floor or the like when the metallic conduit is bent by the bending member, a portion of the frame is separated from the remainder of the frame including the first bending station, the separated frame portion including the second bending station is pivotably connected to the remainder of the frame at a position in the vicinity of the first bending station, the separated frame portion is selectively displacable by a frame actuator from a first alignment where start-of-bending positions of the first and second bending stations are angularly aligned to a second alignment where the start-of-bending positions of the first and seconnd bending stations lie substantially on a single straight line, whereby bending work can be performed initially in the second bending station by moving the bending member towards the frame with the start of bending positions being on the straight line, and then, the bending work can be performed in the first bending station with the metallic conduit being held down in both bending stations and with the bending work being performed by pivoting both the separated frame portion on the side of the second bending station to its first alignment by means of the frame actuator and the bending member with the second bending station.

2. A bending machine according to claim 1, wherein the actuator for moving the bending member is made of an air cylinder.

3. A bending machine according to claim 1, wherein the stationary frame is separated in the vicinity of a termination-of-bending portion between the first and second bending station.

4. A bending machine according to claim 1, wherein the actuator for displacing the separated frame portion is made of an air cylinder.

5. A bending machine according to claim 1, wherein the metallic conduit is held down by the bending members in both bend portions.

6. A bending machine according to claim 1, wherein the separated frame portion has a holding plate additionally.

7. A bending machine according to claim 1, wherein the actuator for moving the bending member comprises a rotary actuator.

8. A bending machine for bending an elongated member into a finished curved shape defining at least first and second curves along the length of the elongated member, said machine comprising:

a first frame portion comprising an elongated first guide surface having opposed first and second ends, said first guide surface comprising a linear section intermediate said ends and a curved section tangent to said linear section and adjacent the second end of said first guide surface, the linear and curved sections defining a first bend plane, portions of the first guide surface which define the linear and curved sections being aligned orthogonal to the first bend plane;

first holding means for selectively holding the elongated member against the linear section of the first guide surface;

a second frame portion comprising an elongated second guide surface having opposed first and second ends, the first end of the second guide surface being disposed in proximity to the second end of the first guide surface, said second guide surface including a curved section intermediate the ends thereof and defining a second bend plane, the linear and curved sections of the second guide surface being parallel to the second bend plane; a curved guide member adjacent the curved secton of the second guide surface and extending from the second bend plane, said sections of said first and second guide surfaces having a shape substantially conforming to the finished curved shape of the metallic conduit over the whole length, said second frame portion being pivotable with respect to the first frame portion about an axis extending substantially perpendicular to the first bend plane from a first alignment where the second bend plane is angularly aligned to the linear section of the first guide surface to a second alignment where the second bend plane and the linear section of the first guide surface are coplanar;

second holding means for selectively holding portions of the elongated member against the second guide surface;

bending means movable towards and away from said second frame and carried by said second frame for selectively bending the elongated member against the guide member; and pivoting means independent of the bending means for selectively pivoting the second frame portion relative to the first frame portion for bending the elongated member against the curved section of the first guide surface, whereby the bending means may be selectively actuated prior to the pivoting means for bending the elongated member against the guide member to avoid interference of the elongated member with a structure spaced from said bending machine.

9. A bending machine as in claim 8 wherein the first guide surface further includes at least one additional curved section intermediate the linear section and the first end thereof, and wherein the bending machine further includes means for bending the elongated member into a curved shape defined by said at least one additional curved section of said first guide surface.

10. A bending machine as in claim 9 wherein the first holding means defines the means for bending the elongated member into the shape defined by the at least one additional curve in the first guide surface.

11. A bending machine as in claim 8 wherein the second guide surface comprises at least one additional curved section, and wherein the bending machine further comprises means for bending the elongated member into a curved shape defined by the at least one additional curved section of said second guide surface.

12. A bending machine as in claim 8 wherein the bending means is mounted to said second frame portion and is pivotable therewith relative to said first frame portion.

13. A bending machine as in claim 12 wherein the bending means comprises a piston and cylinder assembly.

14. A bending machine as in claim 8 wherein the pivoting means is rigidly mounted to the first frame portion and is pivotably connected to the second frame portion.

15. A bending machine as in claim 8 wherein the second holding means is defined by the bending means.

* * * * *